United States Patent [19]

Isozumi

[11] Patent Number: 5,065,038

[45] Date of Patent: Nov. 12, 1991

[54] COAXIAL ENGINE STARTER

[75] Inventor: Shuzoo Isozumi, Himeji, Japan

[73] Assignee: Mitsubishi Denki K.K., Tokyo, Japan

[21] Appl. No.: 466,565

[22] Filed: Jan. 17, 1990

[30] Foreign Application Priority Data

Jan. 18, 1989 [JP] Japan ..... 1-9044

[51] Int. Cl.[5] ..... F02N 11/08

[52] U.S. Cl. ..... 290/48

[58] Field of Search ..... 335/202; 74/6, 7 A; 310/88; 290/48

[56] References Cited

U.S. PATENT DOCUMENTS

| | | | |
|---|---|---|---|
| 4,677,407 | 6/1987 | Tanaka | 335/202 |
| 4,748,862 | 6/1988 | Johnston | 74/6 |
| 4,760,274 | 6/1988 | Isozumi | 74/7 A |
| 4,808,836 | 2/1989 | Isozumi et al. | 74/6 |
| 4,945,270 | 7/1990 | Okamoto | 310/88 |

*Primary Examiner*—A. D. Pellinen

*Assistant Examiner*—L. Colbert

*Attorney, Agent, or Firm*—Sughrue, Mion, Zinn Macpeak & Seas

[57] ABSTRACT

A coaxial engine starter comprising an electric motor including a brush assembly, an output shaft with a pinion and slidable relative to the motor and a solenoid switch having a movable iron core for closing and opening switch contacts. A cylindrical member rearwardly extends from the rear end of the brush assembly of the motor to surround a contact operating space in which the switch contacts move and has a rear edge located close to a front end of the movable iron core to define a small clearance therebetween. A shield member is also disposed behind the movable contact and has an outer edge located close to the rear edge of the tubular member and defines a radially small clearance therebetween. Thus, the cylindrical member and the shield member substantially surround the contact operating space and they are in a telescopically movable relationship relative to each other.

9 Claims, 5 Drawing Sheets

COAXIAL ENGINE STARTER

BACKGROUND OF THE INVENTION

This invention relates to a coaxial engine starter in which an armature rotary shaft of a d.c. motor, a rod of a solenoid switch and a starter output rotary shaft are disposed on a common axis.

FIG. 1 illustrates in a sectional front view one example of a conventional coaxial engine starter disclosed in Japanese Utility Model Laid-Open No. 63-71474. In FIG. 1, reference numeral 1 indicates armature of a d.c. motor, and 2 indicates the a hollow armature rotary shaft secured to the armature 1 and having a face-type commutator 3 at the rear end of the armature 1. 4 indicates a bracket made of resin and holds brushes 5 in sliding contact with the commutator 3 and has integrally molded a stationary contact 6 connected to the brush 5 and a stationary contact 8 connected to an external terminal 7. Within an inner passage 2*a* of the armature rotary shaft 2, an output rotary shaft 9 is disposed and axially slidably supported by a sleeve bearing 10. Mounted at the front end of the output rotary shaft 9 is a pinion 11 to which the rotation of the armature rotary shaft 2 is transmitted through a planetary speed reduction gear 12 and a drive force transmitting mechanism 13 comprising an unillustrated over-running clutch.

Reference numeral 14 indicates a solenoid switch disposed at the rear side of the d.c. motor, and 15 indicates a rod disposed on a common axis with respect to the armature rotary shaft 2 and the output rotary shaft 9. A plunger 16 is secured at the rear end of the rod 15, and a movable contact 17 is mounted through an insulating member 18 so as to be brought into contact with the stationary contacts 6 and 8 when the rod 15 is moved forward. The front end of the rod 15 is inserted into a tubular rod 19, and an intermediate rod 20 is disposed in front of the tubular rod 19 so as to transmit the forward movement of the rod 15 to the output rotary shaft 9. 21 indicated an excitation coil for moving the plunger 16 and is wound around a bobbin 22 made of a resin, and a sleeve 23 is disposed in the inner circumference side of the bobbin 22 within which the plunger 16 slides.

The operation of the above-structured coaxial engine starter will now be described, when an unillustrated starter switch of a vehicle is turned on, the solenoid switch 14 is energized to move the plunger 16 forward, this forward drive force is transmitted to the output rotary shaft 9 through the tubular rod 19 and the intermediate rod 20. Also, at this time, the movable contact 17 abuts against the stationary contacts 6 and 8 to connect the d.c. motor to the power source, so that the rotational drive force of the armature rotary shaft 2 is transmitted to the output rotary shaft 9 through the drive force transmission mechanism 13, and this rotation is transmitted to the pinion 11 which is in engagement with the engine ring gear due to the forwardly moved output rotary shaft 9 whereby the engine is started. Further, when the power source is disconnected from the solenoid switch 14 after the engine has been started, the output rotary shaft 9 is returned to its home position by a return spring, thereby to release the engagement of the pinion 11 and the engine ring gear.

As has been described, the conventional coaxial engine starter has the movable contact 17 and the stationary contacts 6 and 8 disposed with in the inner space defined by the sleeve 23. Therefore, the contact powder generated by contacting and separating of the movable contact 17 and the stationary contacts 6 and 8 as well as the wear particles generated by the vibration of the insulating member 18 supporting the movable contact 17 attach to the sliding surface (the inner circumferential surface of the sleeve 23) of the plunger 16, and the wear powders from the sleeve bearing 10 attach to the sliding surface of the plunger 16 from the inner passage 2*a* of the armature rotary shaft 2 through the central opening of the bracket 4, whereby these foreign matters can easily accumulate on the sliding surface to impede a smooth operation of the plunger 16.

SUMMARY OF THE INVENTION

Accordingly, an object of the present invention is to provide a coaxial engine starter free from the above-discussed disadvantages of the conventional coaxial engine starter.

Another object of the present invention is to provide a coaxial engine starter in which the contact powder or the like is prevented from attaching onto the plunger sliding surface.

Another object of the present invention is to provide a coaxial engine starter in which the smooth operation of the plunger is ensured.

Another object of the present invention is to provide a coaxial engine starter in which the slidably movable plunger is protected from the wear powders or particles with a simple arrangement.

With the above objects in view, the coaxial engine starter of the present invention comprises an electric motor including a brush assembly, an output shaft with a pinion slidable relative to the motor and a solenoid switch having a movable iron core for closing and opening switch contacts. A cylindrical member rearwardly extends from the rear end of the brush assembly of the motor to surround a contact operating space in which the switch contacts move and has a rear edge located close to a front end of the movable iron core to define a small clearance therebetween. A shield member is also disposed behind the movable contact and has a front edge located close to the rear edge of the cylindrical member and defines a radially small clearance therebetween. Thus, the cylindrical member and the shield member substantially enclose the contact operating space and they are in a telescopically movable relationship relative to each other.

BRIEF DESCRIPTION OF THE DRAWINGS

The present invention will become more readily apparent from the following detail description of the preferred embodiments of the present invention taken in conjunction with the accompanying drawings, in which.

DESCRIPTION OF THE PREFERRED EMBODIMENTS

Figure 2:
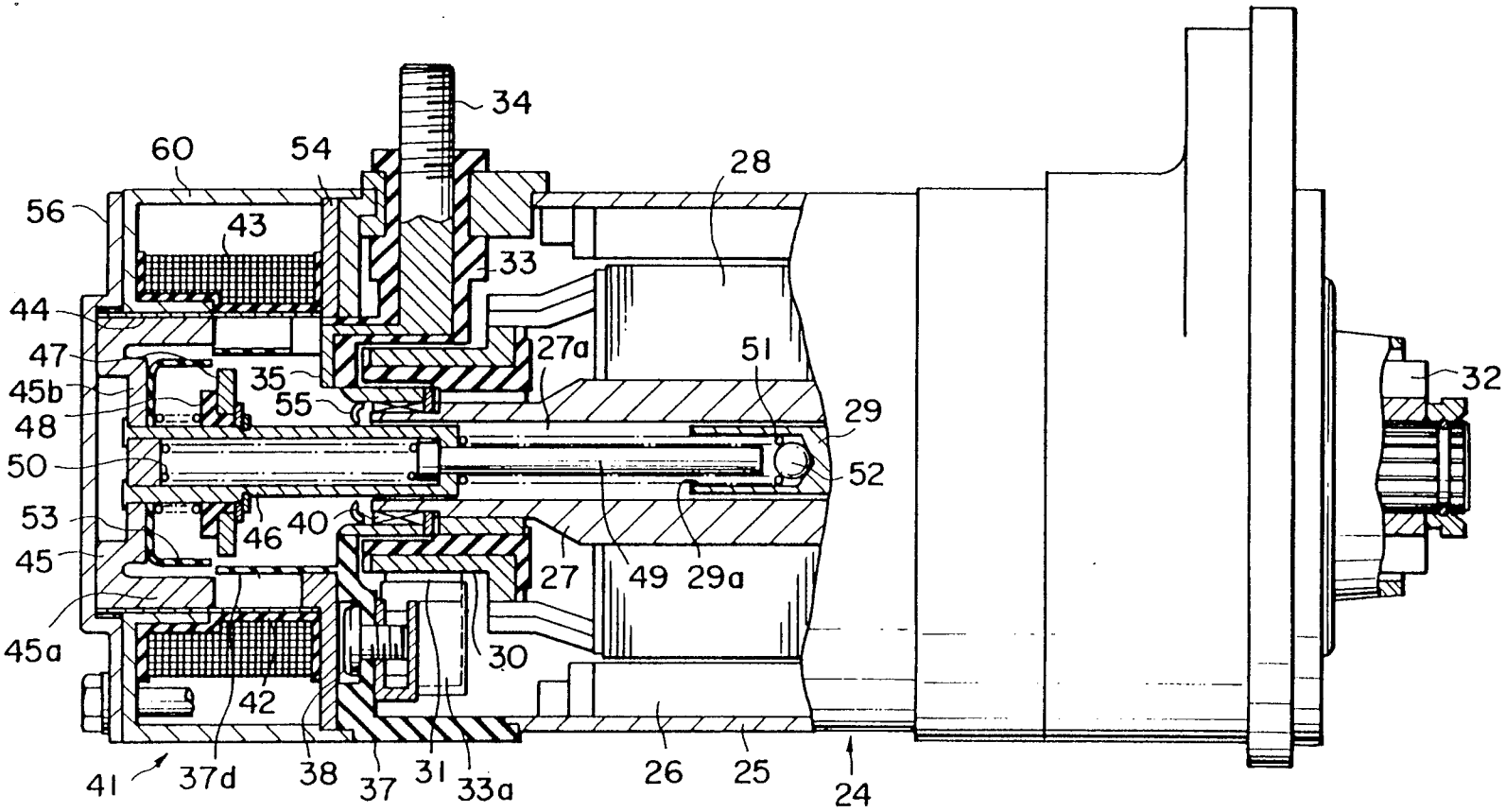
FIG. 2 is a partial sectional front view of the coaxial engine starter of the present invention.
Figure 3:
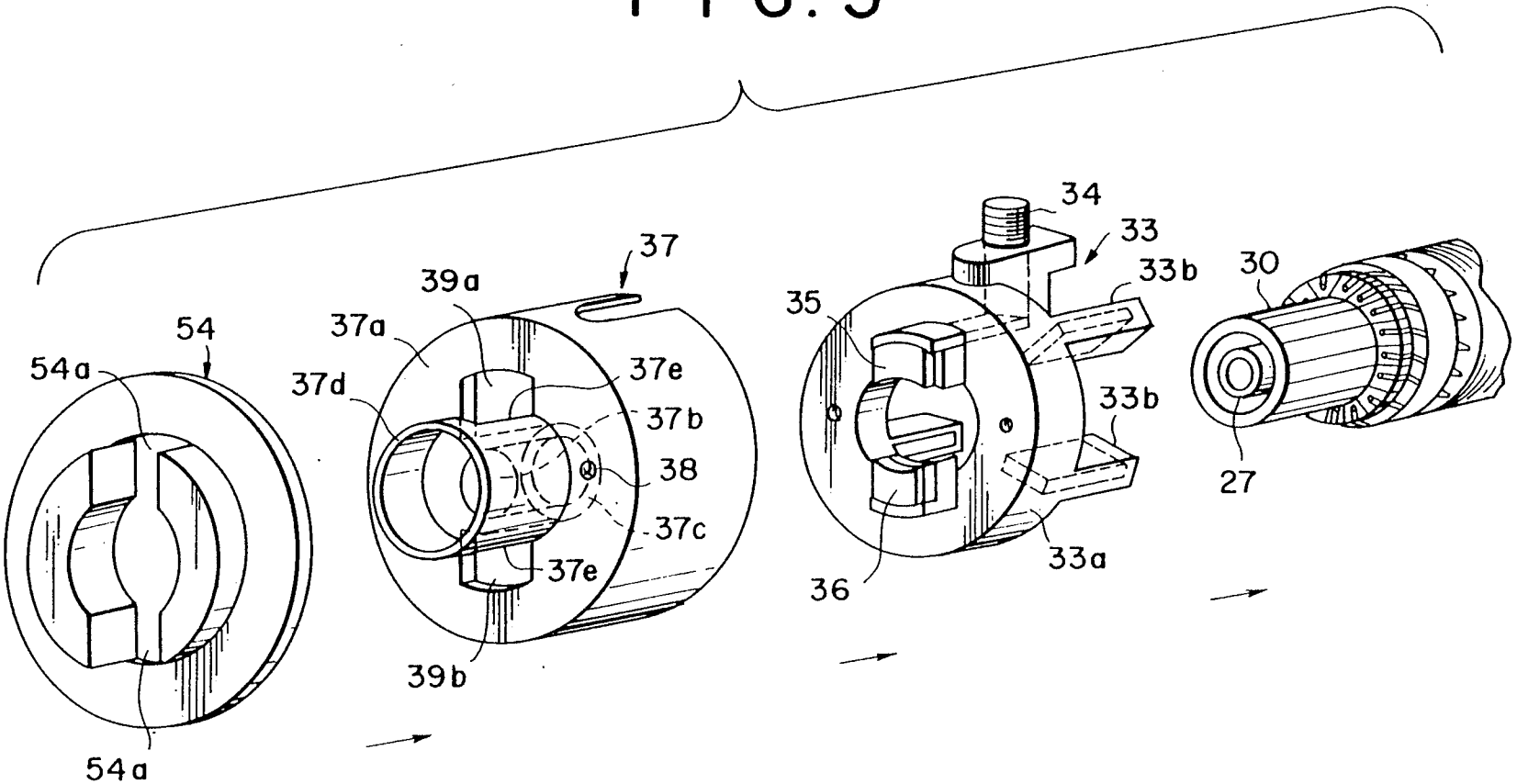
FIG. 3 is an exploded perspective view illustrating the brush assembly of the coaxial engine starter of the present invention shown in FIG. 2.

FIG. 2 illustrates in front view a coaxial engine starter of one embodiment of the present invention, the sectioned portion mainly indicates a solenoid switch, and fIG. 3 illustrates in an exploded perspective view a brush assembly shown in FIG. 2. In these figures, the coaxial engine starter of the present invention comprises a d.c. motor 24 having a yoke 25, at the inner circumferential surface of which permanent magents 26 are securely attached. A hollow armature rotary shaft 27 which is rigidly inserted into an armature core 28 rotatably and axially slidably supports therein an output rotary shaft 29 by an unillustrated sleeve bearing. On the rear end of the armature core 28, a commutator 30 having a cylindrical sliding contact surface is disposed so that it is slidingly contacted by brushes 31 held by a brush holder 33 which will be described later. A pinion 32 is mounted at the front end of the output rotary shaft 29 and the rotation of the armature rotary shaft 27 is transmitted to the pinion 32 through an unillustrated drive force transmission mechanism.

The brush holder 33 is an integrally molded member made of resin comprising an annular main body portion 33*a*, brush holder portions 33*b* for holding the brushes 31, an external terminal 34, a source side stationary contact 35 connected to the external terminal 34, and a brush side stationary contact 36 connected to the brush 31. The brush holder 33 is connected to a substantially cup-shaped housing 37 by screws 38. It is seen that the stationary contacts 35 and 36 are shaped to project from one of major surfaces of the main body portion 33*a* and that the brush holding portions 33*b* are formed on the other major surface of the main body portion 33*a*.

The housing 37 has in its end wall 37*a* through holes 39*a* and 39*b* for exposing the stationary contacts 35 and 36 therethrough and also has at the central portion of the end wall 37*a* an opening 37*b*. Forwardly extended from this opening 37*b* is a cylindrical flange portion 37*c* which rotatably supports through a bearing 40 the rear end of the armature rotary shaft 27. Rearwardly extended from the central portion of the end wall 37*a* is a hollow cylindrical member 37*d* having a rear end in the vicinity of a plunger circumferential wall portion 45*a* as will be described later, and the cylindrical member 37*d* has formed therein notches or windows 37*e* for allowing the stationary contacts 35 and 36 to project therethrough.

The coaxial engine starter of the present invention also comprises a casing 60 for the solenoid switch 41 fitted over the rear end of the housing 37. Disposed within the casing 60 are an excitation coil 43 wound around a bobbin 42 and a sleeve 44 disposed at the inner circumference of the bobbin 42. A plunger 45 which is a substantially cup-shaped movable iron core having a cylindrical circumferential wall portion 45*a* axially slidably disposed within the sleeve 44 and a radially extending disc portion 45*b*, and a tubular rod 46 made of a non-magnetic stainless steel is rigidly secured to the central portion of the plunger 45. This tubular rod 46 has mounted thereon a movable contact 47 through an insulating member 48 for contacting with the stationary contacts 35 and 36, and has inserted therein a push rod 49 biased by a compression spring 50 in the forward direction. The front end portion of the tubular rod 46 is located at the inner passage 27*a* of the armature rotary shaft 27, and the front end portion of the push rod 49 is inserted into the rear end bore 29*a* of the output rotary shaft 29. Also, a spring 51 is disposed for maintaining a steel ball 42 in place within the rear end bore 29*a*.

On the front-side face of the plunger 45, a cover 53 which is a substantially cup-shaped shield member having a bottom wall attached to the plunger 45 and a cylindrical wall integrally extending in the axial direction from the periphery of the bottom wall so that its open end is mounted to face toward the d.c. motor. It is seen that the front end of the shield member 53 is located slightly radially inward of the rear end 37*d* of the cylindrical member 37*d*. Also, the diameters of the shield member 53, the cylindrical member 37*d* and the circumferential wall portion 45*a* are determined to define small radial clearances between each of them. Thus, a labyrinth seal structure is formed between these components, while allowing a telescopically movable relationship between them, and a contact operating space in which the movable contact 47 moves into and out of engagement with the stationary contacts 35 and 36 is substantially enclosed by the shield member 53, the cylindrical member 37*d* and the cylindrical wall 45*a* of the plunger 45.

In order to provide a magnetic circuit for the solenoid switch 41 together with the casing, an iron core 54 is intimately mounted on the end wall 37*a* of the housing 37. The iron core 54 has notches or windows 54*a* formed at the locations corresponding to the positions of the stationary contacts 35 and 36 so that the stationary contacts 35 and 36 are allowed to project through the windows 54*a*. Reference numeral 55 indicates a seal member disposed on the inner circumference of the cylindrical flange portion 37*c* of the housing 37, and 56 indicates a non-magnetic plate for covering the rear end of the solenoid switch 41.

With the coaxial engine starter of the above-described structure, the contact operating space in which the movable contact 47 moves and the central opening in the housing 37 and the iron core 54 which is in communication with the inner passage 27*a* of the armature rotary shaft 27, so that the contact powders generated by the abutment and separation of the movable contact 47 with respect to the stationary contacts 35 and 36, wear powders generated between the movable contact 47 and the insulating member 48, as well as the wear particles and powders or the like of the sleeve bearing disposed between the armature rotary shaft 27 and the output rotary shaft 29 and which otherwise enter the solenoid switch 41 through the openings are not allowed to reach the clearance between the sliding surfaces of the plunger 45 and the sleeve 44, whereby the attachment of the above powders can be prevent.

Figure 1:
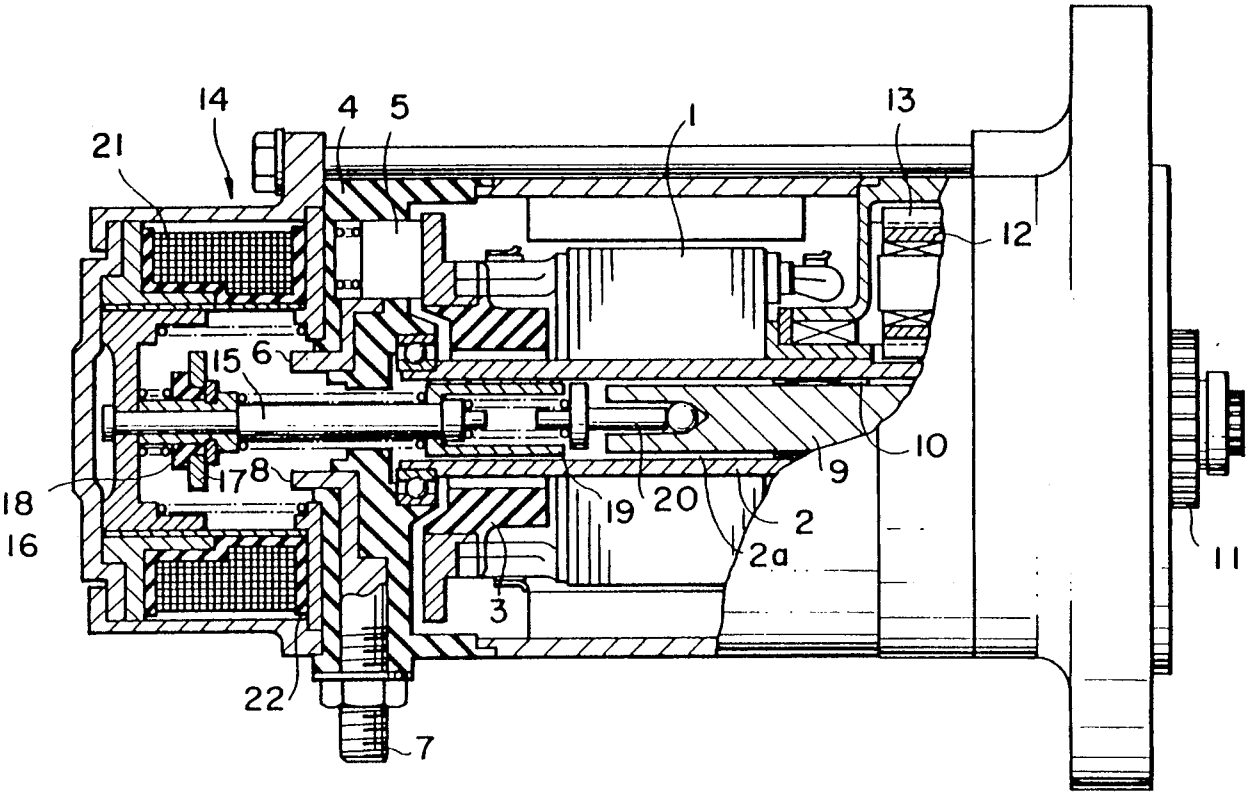
FIG. 1 PRIOR ART
FIG. 1 is a partial sectional front view of a conventional coaxial engine starter.

The engine starting operation of the above-described coaxial engine starter is similar to that of the conventional coaxial starter illustrated in FIG. 1 in that simultaneously with the rotation of the d.c. motor 24 the solenoid switch 41 causes rotating pinion 32 on the output rotary shaft 29 to be driven forward into engagement with the engine ring gear to start the engine. Therefore, detailed description of the operation will be omitted.

Figure 4:
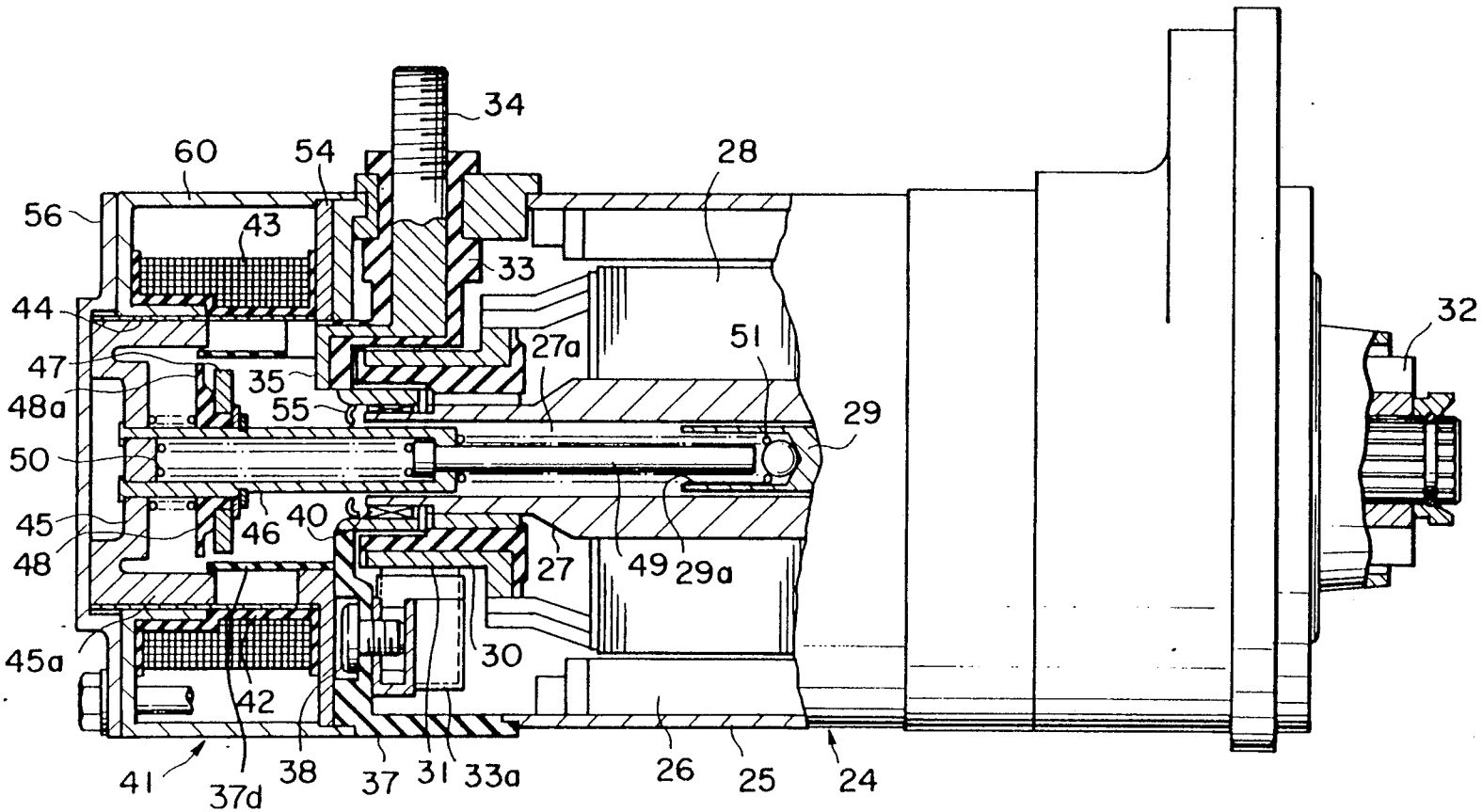
FIG. 4 is a partial sectional front view of the coaxial engine starter of another embodiment of the present invention.

FIG. 4 illustrates another embodiment of the coaxial engine starter of the present invention in which the insulating member 48 supporting the movable contact 47 has a shield member which is a radial extension 48*a* extended from the outer periphery of the insulating member 48. The outer edge of the radial extension 48*a* defines a small annular clearance between it and the inner circumference of the cylindrical member 37*d* so that a labyrinth seal structure is provided by the outer edge of the radial extension 48*a*, the rear end of the cylindrical member 37*d* and the front end of the cylindrical portion 45*a* of the plunger 45. Therefore, the contact operating space in which the movable and stationary contacts 47, 35 and 36 are disposed is substantially enclosed by the radial extension 48*a* of the insulating member 48 and the cylindrical member 37*d*. Other construction is the same as those illustrated and described in conjunction with FIG. 2.

With the coaxial engine starter thus constructed, the wear particles or powders generated from the contacts or the like are prevented from attaching to the sliding surfaces of the plunger 45 and the sleeve 42.

Figure 5:
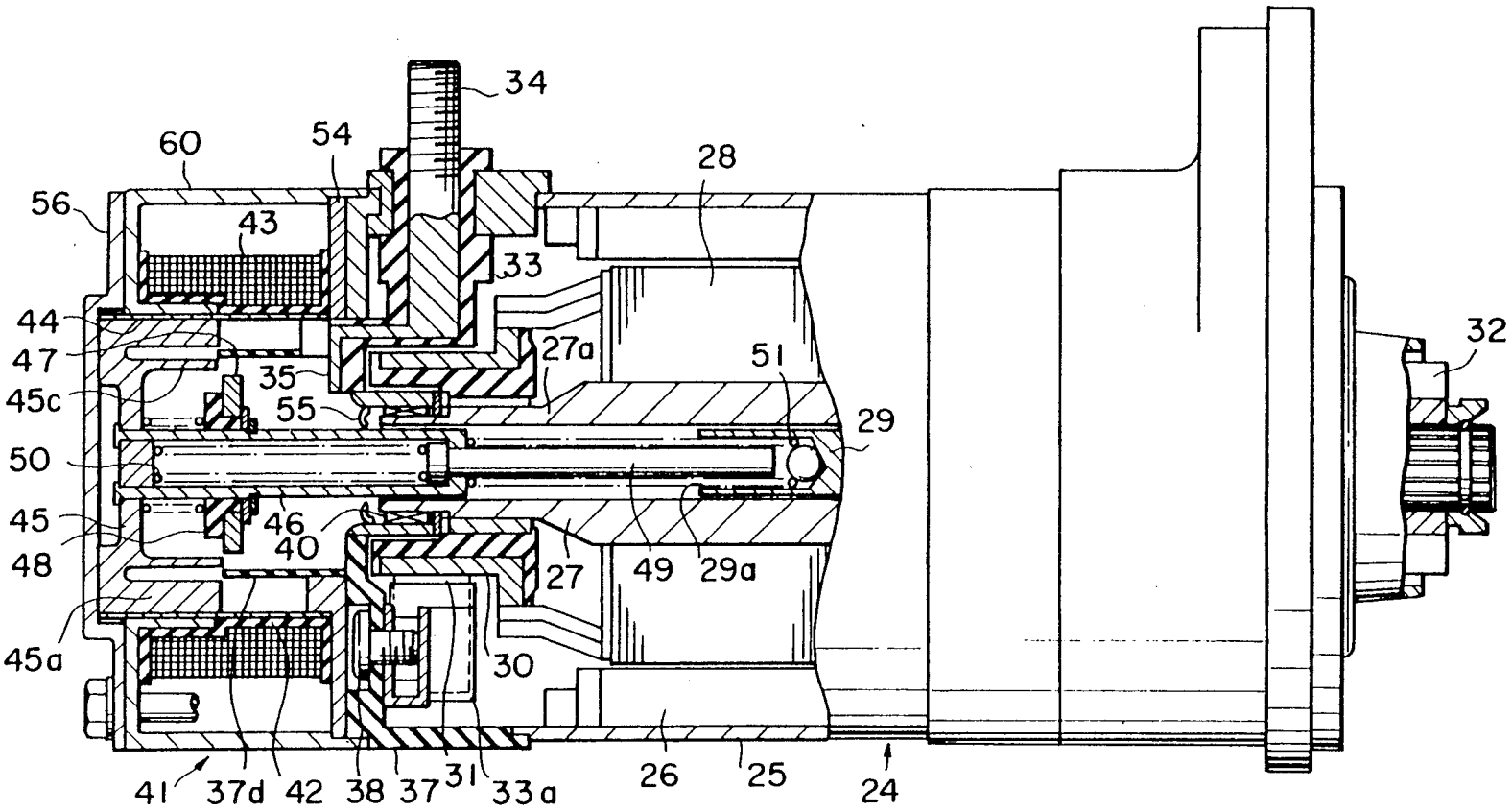
FIG. 5 is a partial sectional front view of the coaxial engine starter of a still another embodiment of the present invention.

FIG. 5 illustrates a still another embodiment of the coaxial engine starter of the present invention in which the plunger 45 has integral formed thereon a shield member which is an integral cylindrical extension 45*c* in place of the cup-shaped cover 53 shown in FIG. 2. The cylindrical extension 45*c* has its front end terminated at substantially the same axial position as the front end of the cylindrical portion 45*a* of the plunger 45 and slightly inside of the rear end of the cylindrical member 37*d*. This extension 45*c* has similar function to the cylindrical wall of the cup-shaped member 53 of the embodiment shown in FIG. 2. In other respects, the arrangement is the same as that of the embodiment shown and described in conjunction with FIG. 2.

While some preferred embodiments of the present invention have been described, many modifications can be achieved. For example, the cylindrical member 37*d* integrally extending from the housing 37 of the brush assembly may be made a separate component attached to the housing 37 by any suitable fastening means such as screws. Also, the cylindrical member 37*d* can be extended from the brush holder 33. The rear end of the cylindrical member 37*d* may be extended further beyond the front end of the cylindrical portion 45*a* of the plunger 45 as long as it does not interfere with proper movement of the plunger 45. Further, the front end of the cover 53 of the embodiment shown in FIG. 2 and the front end of the integral extension 45*c* of the embodiment of FIG. 5 may be extended forward beyond the rear end of the cylindrical member 37*d*. Also, the configuration of the shield member is not limited to those of the cover 53, the flange portion 48*a* and the integral extension 45*c* as long as it defines a slight clearance relative to the cylindrical member 37*d* and substantially enclose in cooperation with the cylindrical member 37*d* the contact operating space.

As has been described, according to the coaxial engine starter of the present invention, the contact operating space in which the contacts are moved to engage and disengage is substantially enclosed by the cylindrical member, the shield member and the plunger, so that contact powder and the wear powder formed between the movable contact and the insulating member as well as the wear powder from the sleeve bearing disposed between the armature rotary shaft and the output rotary shaft are prevented from flying on and attaching to the sliding surface of the plunger and sleeve, ensuring smooth and proper sliding movement of the plunger.

What is claimed is:

1. A coaxial engine starter of the type comprising an electric motor having an armature rotary shaft of a d.c. motor, a rod of a solenoid switch and a starter output rotary shaft disposed along a common axis;

an output shaft axial aligned to and slidable relative to said armature rotary shaft and having a pinion at its front end;

said solenoid switch axially aligned to said armature rotary shaft and having a movable iron core slidable at the inside of an excitation coil;

a hollow cylindrical member extending from the rear end of said motor to surround a contact operating space in which said movable contact moves and having an open rear end positioned close to a front end of said movable iron core to define a small clearance therebetween; and a shield member disposed at the rear portion of said movable contact and having an outer end positioned close to the rear end of said cylindrical member and defining a small radial clearance therebetween, and shield member and said cylindrical member being in a telescopically movable relationship relative to each other, substantially enclosing said contact operating space therein, said shield member, said hollow cylindrical member, and a cylindrical wall of said movable contact forming a labyrinth seal structure.

2. A coaxial engine starter as claimed in claim 1, wherein said iron core of said solenoid switch includes a hollow cylindrical portion having a front end defining a small radial clearance between it and said rear end of said cylindrical member, whereby said shield member, said cylindrical member and said cylindrical portion of said iron core together defining a labyrinth seal structure.

3. A coaxial engine starter as claimed in claim 1, wherein said d.c. motor comprises a brush assembly at the rear end of the motor, and said cylindrical member is supported from said brush assembly.

4. A coaxial engine starter as claimed in claim 3, wherein said cylindrical member is an integral extension extending from said brush assembly.

5. A coaxial engine starter as claimed in claim 3, wherein said cylindrical member is a separate member secured to said brush assembly.

6. A coaxial engine starter as claimed in claim 1, wherein said shield member is a substantially cup-shaped member, with its open end facing toward the d.c. motor and its bottom wall attached to said movable iron core.

7. A coaxial engine starter as claimed in claim 1, wherein said shield member is a substantially cylindrical integral extension extending from said movable iron core.

8. A coaxial engine starter as claimed in claim 1, wherein said shield member is a substantially disc-shaped member supported on the movable contact for movement therewith and having an outer peripheral edge located inside of said cylindrical member defining a small clearance therebetween.

9. A coaxial engine starter as claimed in claim 1, wherein a seal member is disposed on an inner circumference of a cylindrical flange of said hollow cylindrical member.

* * * * *